US009216131B2

(12) United States Patent
Nakashima et al.

(10) Patent No.: US 9,216,131 B2
(45) Date of Patent: Dec. 22, 2015

(54) WALKING ASSIST DEVICE

(75) Inventors: Issei Nakashima, Toyota (JP); Shuhei Manabe, Miyoshi (JP)

(73) Assignee: TOYOTA JIDOSHA KABUSHIKI KAISHA, Toyota-Shi (JP)

( * ) Notice: Subject to any disclaimer, the term of this patent is extended or adjusted under 35 U.S.C. 154(b) by 675 days.

(21) Appl. No.: 13/509,449

(22) PCT Filed: Nov. 13, 2009

(86) PCT No.: PCT/JP2009/069319

§ 371 (c)(1),
(2), (4) Date: May 11, 2012

(87) PCT Pub. No.: WO2011/058641

PCT Pub. Date: May 19, 2011

(65) Prior Publication Data

US 2012/0226203 A1 Sep. 6, 2012

(51) Int. Cl.
*A61H 1/02* (2006.01)
*A61H 3/00* (2006.01)

(52) U.S. Cl.
CPC ..... *A61H 3/00* (2013.01); *A61H 2201/0176* (2013.01); *A61H 2201/1215* (2013.01); *A61H 2201/165* (2013.01); *A61H 2201/5061* (2013.01); *A61H 2201/5069* (2013.01); *A61H 2201/5079* (2013.01); *A61H 2205/102* (2013.01)

(58) Field of Classification Search
CPC ..... A61H 3/00; A61H 2201/0176; A61H 2201/1215; A61H 2201/5061; A61H 2201/5069; A61H 2201/5079; A61H 2201/165; A61H 2205/102
USPC ..... 601/5, 23, 24, 27, 28, 29, 31, 33, 34, 601/35; 602/5, 16, 23–29
See application file for complete search history.

(56) References Cited

U.S. PATENT DOCUMENTS 6,969,365 B2 11/2005 Scorvo
7,857,774 B2 12/2010 Sankai
8,147,436 B2 4/2012 Agrawal et al.
(Continued)

FOREIGN PATENT DOCUMENTS

JP 7-163607 A 6/1995
JP 2000-107213 A 4/2000
(Continued)

OTHER PUBLICATIONS

Translation of International Preliminary Report on Patentability and Written Opinion of ISA of PCT/JP2009/069319.
(Continued)

*Primary Examiner* — Quang D Thanh
(74) *Attorney, Agent, or Firm* — Kenyon & Kenyon LLP

(57) ABSTRACT

To provide a walking assist device which can apply torque to a knee joint at a suitable timing. A walking assist device includes an actuator, a reaction force sensor and an angle sensor. The walking assist device is fitted to a user's leg. The actuator is able to apply torque to a knee joint of one leg of the user. The reaction force sensor detects a reaction force that the foot of the one leg receives from the floor. The angle sensor detects a hip joint angle of the one leg around a pitch axis. The walking assist device specifies a timing to start applying the torque to the knee joint in a direction that swings the lower leg backward, based on the detected reaction force and the detected hip joint angle.

3 Claims, 7 Drawing Sheets

(56) References Cited

U.S. PATENT DOCUMENTS

| | | | | |
|---|---|---|---|---|
| 8,690,802 | B2 | 4/2014 | Sankai | |
| 2004/0158175 | A1 | 8/2004 | Ikeuchi et al. | |
| 2004/0249316 | A1 | 12/2004 | Ashihara et al. | |
| 2005/0177080 | A1 | 8/2005 | Yasuhara et al. | |
| 2006/0211956 | A1 | 9/2006 | Sankai | |
| 2006/0276728 | A1* | 12/2006 | Ashihara et al. | 601/5 |
| 2007/0054777 | A1* | 3/2007 | Kawai et al. | 482/1 |
| 2008/0139968 | A1 | 6/2008 | Endo et al. | |
| 2008/0161937 | A1 | 7/2008 | Sankai | |
| 2008/0188907 | A1 | 8/2008 | Aguirre-Ollinger et al. | |
| 2008/0234608 | A1* | 9/2008 | Sankai | 601/5 |
| 2009/0062884 | A1 | 3/2009 | Endo et al. | |
| 2009/0131839 | A1 | 5/2009 | Yasuhara | |
| 2009/0192414 | A1 | 7/2009 | Yasuhara | |
| 2009/0227424 | A1 | 9/2009 | Hirata et al. | |
| 2009/0270766 | A1 | 10/2009 | Yasuhara | |
| 2009/0319054 | A1 | 12/2009 | Sankai | |
| 2010/0271051 | A1 | 10/2010 | Sankai et al. | |

FOREIGN PATENT DOCUMENTS

| | | | |
|---|---|---|---|
| JP | 2004-261622 | A | 9/2004 |
| JP | 2004-329520 | A | 11/2004 |
| JP | 2005-000500 | A | 1/2005 |
| JP | 2005-211086 | A | 8/2005 |
| JP | 2006-167223 | A | 6/2006 |
| JP | 2006-314670 | A | 11/2006 |
| JP | 2007-061527 | A | 3/2007 |
| JP | 2007-275482 | A | 10/2007 |
| JP | 2008-068046 | A | 3/2008 |
| JP | 2009-254740 | A | 11/2009 |
| JP | 2010-148637 | A | 7/2010 |
| WO | 2009/084387 | A1 | 7/2009 |

OTHER PUBLICATIONS

International Search Report mailed Dec. 28, 2009 of PCT/JP2009/069319.

Office Action mailed Jul. 29, 2014 in U.S. Appl. No. 13/242,688.

Notice of Allowance mailed Feb. 17, 2015 in U.S. Appl. No. 13/242,688.

* cited by examiner

| Transition | Floor Reaction Force Fr | Relative Position Pr | Velocity Vr | Duration Time Td |
|---|---|---|---|---|
| A | | <Xa | | |
| B | <Fb | Xb< | Vb< | |
| C | <Fp | <Xp | | |
| D | Fd< | Xd< | <Vd | |
| E | | | | Td1< |
| F | | | | Td2< |

| Transition | Grounding Sensor | Relative Position Pr | Velocity Vr | Duration Time Td |
|---|---|---|---|---|
| A | | <Xa | | |
| B | ON→OFF | Xb< | Vb< | |
| C | ON→OFF | <Xp | | |
| D | OFF→ON | Xd< | <Vd | |
| E | | | | Td1< |
| F | | | | Td2< |

WALKING ASSIST DEVICE

This is a 371 national phase application of PCT/JP2009/069319 filed 13 Nov. 2009, the contents of which are incorporated herein by reference.

TECHNICAL FIELD

The present invention relates to a walking assist device which assists a walking motion of a user.

BACKGROUND ART

A walking assist device which assists a walking motion by applying torque to a leg joint of a user has been researched. Patent document 1, for example, discloses a walking assist device which assists walking of a user having one leg that does not move freely. Hereinafter, in the present specification, a leg which the user can move freely is called a "sound leg" and a leg in which the user cannot freely move at least one joint is called an "affected leg". Furthermore, in the present specification, the portion from the knee to the ankle is called "lower leg". The walking assist device disclosed in Patent document 1 measures a pattern of motion of a sound leg with a sensor, and applies torque to a joint of an affected leg in such a manner that the pattern of motion of the affected leg follows the pattern of motion of the sound leg.

Patent document 1: Japanese Patent Application Publication No. 2006-314670

SUMMARY OF INVENTION

The user feels discomfort if the leg movement desired by the user does not match the movement induced by the torque applied to the joint by the walking assist device. Research carried out by the inventors found that a user particularly feels discomfort if a timing at which the lower leg starts to swing backward in a transition phase from a standing leg to an idling leg does not match a timing at which the device starts to apply torque.

If a sensor is attached to the sound leg, as in the technique described in Patent document 1, then it is possible to measure the pattern of motion of the sound leg. By applying the torque to the knee joint of the affected leg so as to achieve the same pattern of motion as the sound leg, the walking motion of the user can be assisted without causing the user to feel discomfort. However, it is bothersome for the user to attach sensors to both legs. The present invention provides a walking assist device which assists a walking motion by applying torque to a joint of one leg, based on an output of a sensor attached to that leg. This walking assist device is able to apply the torque to the knee joint of one leg at a suitable timing during the transition of the leg from a standing leg period to an idling leg period, without using information from the other leg. In other words, this walking assist device is able to assist the walking motion without causing the user to feel discomfort. The technique disclosed by the present specification is suitable for a walking assist device for a user having one affected leg. This walking assist device can assist the motion of an affected leg suitably, without attaching a sensor to the sound leg.

One novel technique disclosed by the present specification installs an angle sensor that detects a joint angle and a reaction force sensor that detects a floor reaction force on one leg of a user, and determines a timing to start applying torque to the knee joint in a direction in which the torque swings a lower leg of the one leg backward, based on the detected data from the sensors. The angle sensor detects at least an angle of the hip joint around a pitch axis. Hereinafter, the angle of the hip joint around the pitch axis is called the "hip joint angle". The novel walking assist device disclosed by the present specification detects that the foot of the one leg is positioned backward than the foot of the other leg, in other words, that the one leg is in a transition phase from a standing leg to an idling leg, based on the detected hip joint angle. Simultaneously, the walking assist device determines the timing at which the lower leg starts swinging backward in this transition phase, based on a magnitude of the detected floor reaction force. The walking assist device can start to apply the torque to the knee joint at a suitable timing, without requiring a sensor to be attached to the other leg. The novel technique disclosed by the present specification can achieve a walking assist device which assists walking of the user, simply by a device that is installed only on an affected leg.

The mechanism which applies the torque to the knee joint of the user may typically be a wearable device comprising an upper link attached to the upper leg, a lower link attached to the lower leg, and a mechanical joint which connects these two links together. In the present specification, the device attached on the user's leg may be called a "leg brace" (or a leg attachment). The mechanical joint is provided with a motor which causes the lower link to swing. When this leg brace is attached on the user, the mechanical joint is positioned substantially coaxially with the knee joint of the user.

Hereinafter, in order to simplify the description, the one leg of the user is called a "first leg" and the other leg is called a "second leg".

In a preferable embodiment of the technique disclosed by the present specification, the walking assist device estimates a relative position of the foot of the first leg with respect to a hip in a horizontal direction, based on the detected hip joint angle; and the walking assist device starts to apply the torque to the knee joint in the direction in which the torque swings the lower leg backward at a timing when the detected reaction force decreases below a reaction force that had been set in advance while the foot of the first leg is positioned backward from the hip by a distance that had been set in advance or more. Hereafter, the "distance that had been set in advance" may be called "predetermined distance", and the "reaction force that had been set in advance" may be called "predetermined reaction force". The "timing when the detected reaction force decreases below a predetermined reaction force" corresponds to the timing at which the detected reaction force changes from a value exceeding the predetermined reaction force to a value equal to or lower than the predetermined reaction force. The predetermined distance depends on the physique and stride of each user, and the like, and the predetermined reaction force depends on the user's weight, walking speed, and the like. Therefore, the predetermined distance and the predetermined reaction force are determined in advance by experimentation and/or testing. However, the "predetermined distance" is a value greater than zero. By determining the timing to start applying torque as described above, the walking assist device is able to start applying the torque at a timing appropriately in the user's series of walking motions.

It should be noted that specifying the timing to start applying torque as a timing including a slight offset time from the timing when the detected reaction force decreases below the predetermined reaction force also comes within the scope of the technical concept of the present invention. The walking assist device disclosed by the present specification prevents, at the least, a large disparity between the timing at which the user intends to swing the lower leg backward and the timing at which the walking assist device starts to apply torque. The large disparity in these timings causes a large discomfort feeling in the user. The walking assist device disclosed by the present specification reduces the discomfort feeling of this kind. Therefore, the technical concept disclosed by the present specification also includes a device which applies a slight offset, as described above.

The relative position of the foot with respect to the hip position is estimated from the hip joint angle, assuming that the upper leg and the lower leg form a single straight line, or assuming that the upper leg and the lower leg form a uniform angle. Preferably, the hip joint angle can be detected as an absolute angle with respect to a vertical line, but it may also be a relative angle with respect to a user's trunk. This is because the trunk is usually approximately vertical. If the knee joint angle can be detected, then an accurate relative position is estimated from the hip joint angle and the knee joint angle.

Preferably, the magnitude of the predetermined reaction force is greater than zero. It is known that in the transition phase from the standing leg to the idling leg, the lower leg starts to swing backward before the foot completely leaves a ground. This movement is called the "pre-swing". In the pre-swing period, the heel lifts up and the lower leg starts to swing backward. At the same time, the reaction force acting on the foot starts to decrease. The timing at which the detected reaction force decreases below the predetermined reaction force coincides substantially with the timing at which the lower leg starts to swing backward. Therefore, by starting to apply the torque at the timing when the detected reaction force decreases below the predetermined reaction force, the walking assist device disclosed in the present specification can assist the walking motion while reducing the discomfort feeling of the user.

As stated above, preferably, the predetermined reaction force for determining the timing is greater than zero. Even if the magnitude of the predetermined reaction force is set to zero, the walking assist device disclosed in the present specification can achieve second-best advantages. By setting the magnitude of the predetermined reaction force to zero, it is possible to employ a grounding sensor instead of the reaction force sensor. In other words, one preferred embodiment of the technique disclosed by the present specification comprises a grounding sensor that detects a timing when a foot of a first leg leaves the ground, and a rotation angle sensor that detects the hip joint angle of the first leg (the angle around the pitch axis). In this embodiment, moreover, the relative position of the foot of the first leg with respect to the hip, in the horizontal direction, is estimated based on the detected hip joint angle. Moreover, in this embodiment, the walking assist device starts to apply the torque to the knee joint in the direction in which the torque rotates the lower leg backward at a timing when the foot of one leg leaves the ground while the foot of the first leg is positioned backward from the hip at the predetermined distance or more. Even in a configuration of this kind, the walking assist device disclosed in the present specification is able to apply torque to the knee joint at an appropriate timing, as a result of which it is possible to assist the walking motion while reducing the discomfort feeling caused in the user.

DESCRIPTION OF EMBODIMENTS

Figure 1:
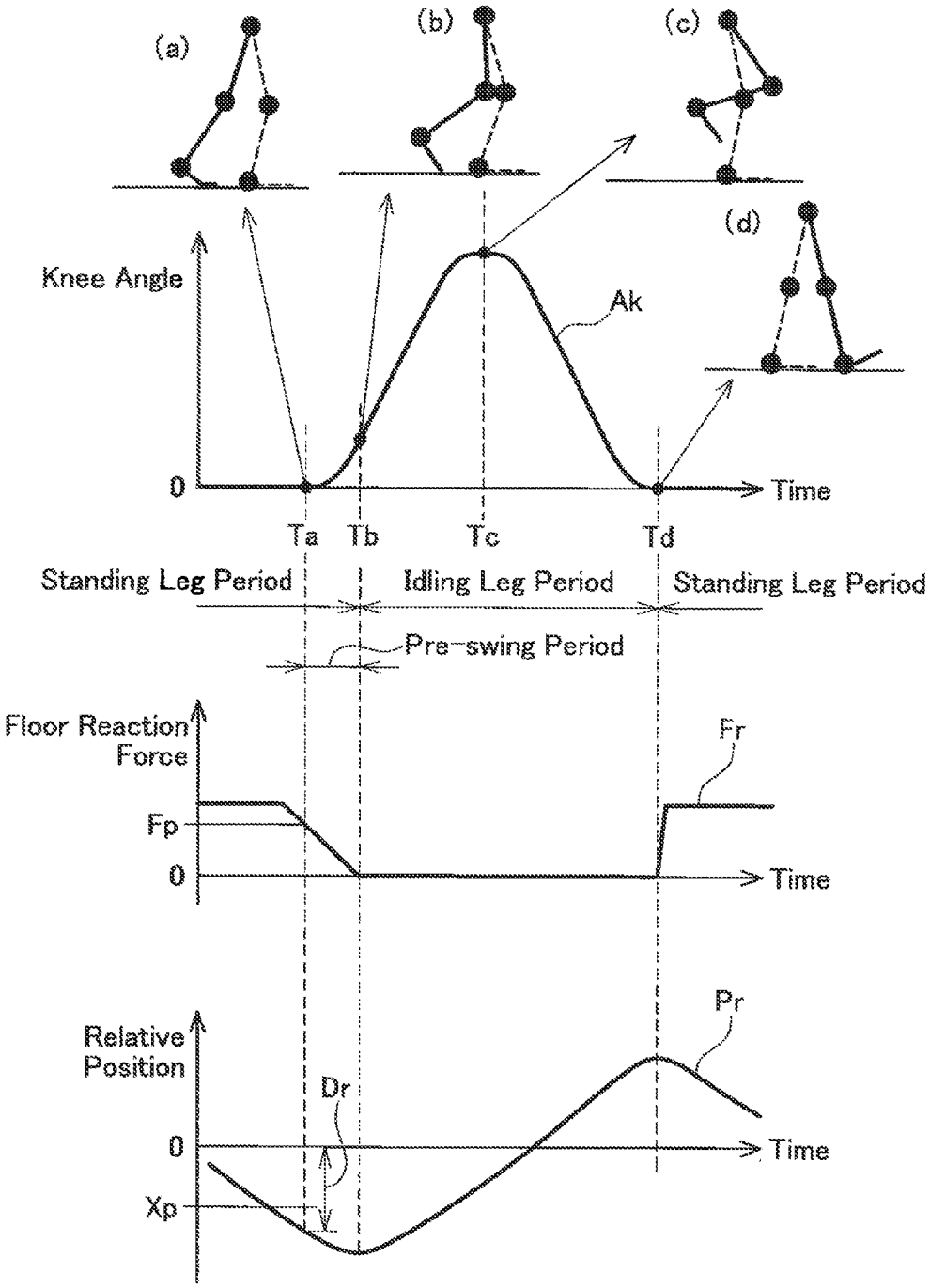
FIG. 1 is a diagram for describing the motion of a leg during walking.

Before describing a preferred embodiment of the present invention, a motion of a leg during walking will be described. FIG. 1 is a diagram for describing the motion of a first leg during walking. The graph labeled with reference symbol. Ak shows time change in an angle of a knee joint (knee angle) Ak of the first leg. The graph labeled with reference symbol Fr shows time change in a floor reaction force Fr received by a foot of the first leg. Reference symbol Pr indicates the time change in the relative position of the foot of the first leg with respect to a hip. Reference symbol Dr indicates a distance in a horizontal direction between the foot of the first leg and the hip. Reference symbol Xp indicates a reference for judging the state of the first leg (predetermined relative position). The predetermined position Xp is described hereinafter. In the description given below, the right leg of the user corresponds to the first leg and the left leg corresponds to the second leg. It should be noted that the graph in FIG. 1 shows an approximation (tendency) of the time change in the respective parameters, and does not provide a precise indication thereof. Furthermore, it should be noted that in FIG. 1, a portion of the standing leg period is omitted from the drawing.

Figure 2:
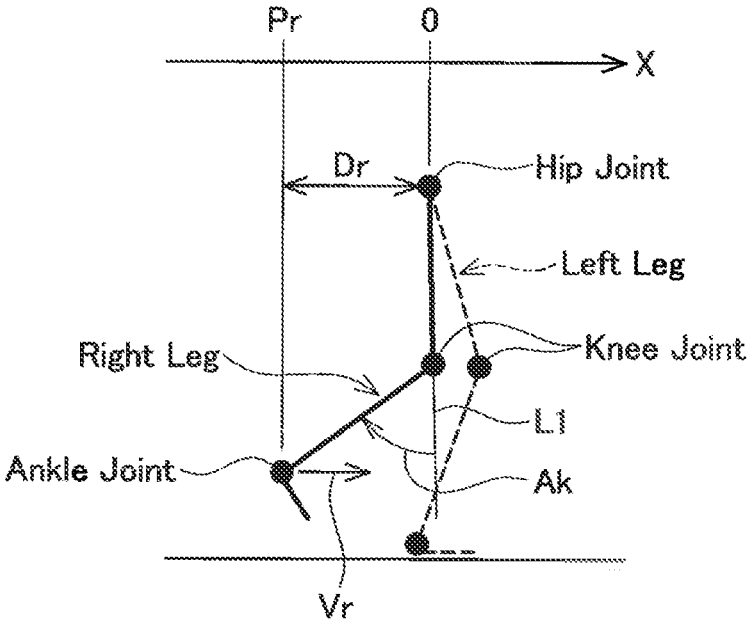
FIG. 2 is a diagram for describing parameters used in FIG. 1.

FIG. 2 is a diagram illustrating the knee angle Ak and the relative position Pr. In FIG. 2, the solid line represents the first leg (right leg), and the dotted line represents the second leg (left leg). The same applies to FIG. 1. The straight line L1 is a straight line linking the hip joint and the knee joint. The straight line L1 corresponds to a straight line along the longitudinal direction of the upper leg. The knee angle Ak is shown as the angle from the straight line L1 to the lower leg. When the knee is fully extended, the knee angle Ak=0. When the knee is bent in a right angle, the knee joint angle Ak is +90 degrees.

The relative position Pr indicates the position of the foot on the X axis, with reference to a point of origin which is the hip position, and expresses a forward direction of the user as a positive value. Therefore, when the foot is positioned backward from the hip, the relative position Pr takes a negative value. Furthermore, in other words, the relative position Pr is the relative position of the foot with respect to the hip, in the horizontal direction. More precisely, the relative position Pr is the relative position of the foot in a horizontal front/rear direction. In the present embodiment, the relative position is expressed as the position of the ankle of the foot. Furthermore, a velocity of the foot (ankle) in the horizontal front/rear direction is expressed by the symbol Vr. The velocity Vr is obtained by time differentiation of the relative position of the foot.

A walking motion is now described, returning to FIG. 1. Timing Ta is a timing at which a heel of the foot of the first leg starts to lift up. (a) in FIG. 1 shows a configuration of the leg at the timing Ta. The knee angle Ak starts to change at the timing Ta. In other words, as indicated by the solid line (first leg) in (a) in FIG. 1, at the timing Ta, the lower leg starts to swing backward while a tip of the foot remains in contact with a floor. The reaction force (the reaction force received by the foot of the first leg from the floor) Fr starts to decrease from a time slightly before Ta. The symbol Fp indicates a reference (predetermined reaction force) for detecting the timing Ta. The predetermined reaction force Fp is described hereinafter.

Timing Tb is a timing at which the foot leaves a ground. (b) in FIG. 1 shows a configuration of the leg at the timing Tb. The reaction force Fr is zero at the timing Tb. Furthermore, the relative position Pr starts to increase from the timing Tb. In other words, the foot of the first leg starts to swing forward. At and before the timing 11), the relative position decreases with time.

The timing Tc indicates the timing at which the knee angle Ak becomes a maximum. (c) in FIG. 1 shows a configuration of the leg at the timing Tc. The timing Td shows the timing at which the first leg touches the ground. (d) in FIG. 1 shows a configuration of the leg at the timing Td. The floor reaction force Fr increases dramatically from timing Td.

The period from timing Tb to timing Td corresponds to the idling leg period of the first leg. The period before timing Tb and after timing Td correspond to the standing leg period of the first leg. In FIG. 1, a portion of the standing leg period is omitted from the drawing. A period from timing Ta to timing Tb is a period in which the knee angle changes while the foot of the first leg is in contact with the ground, and is called a pre-swing period. As FIG. 1 reveals, from the timing Ta, the lower leg starts to swing backward. In other words, the timing at which the lower leg starts to swing backward during the standing leg period corresponds to the start of the pre-swing period. Below, the timing at which the lower leg starts to swing backward is called the pre-swing timing. The timing Ta in FIG. 1 corresponds to the pre-swing timing.

Preferably, the walking assist device which applies torque to the knee joint of the first leg estimates this pre-swing timing Ta, and starts to apply the torque in a direction to cause the lower leg to swing backward at the pm-swing timing. A preferred embodiment of the walking assist device of this kind is described below.

Figure 3A:
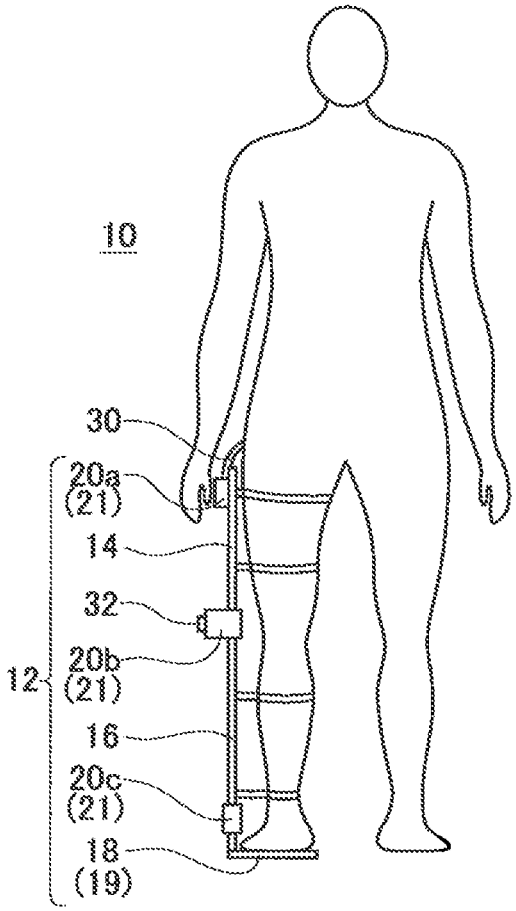
FIG. 3A is a schematic front view of a walking assist device according to an embodiment.
Figure 3B:
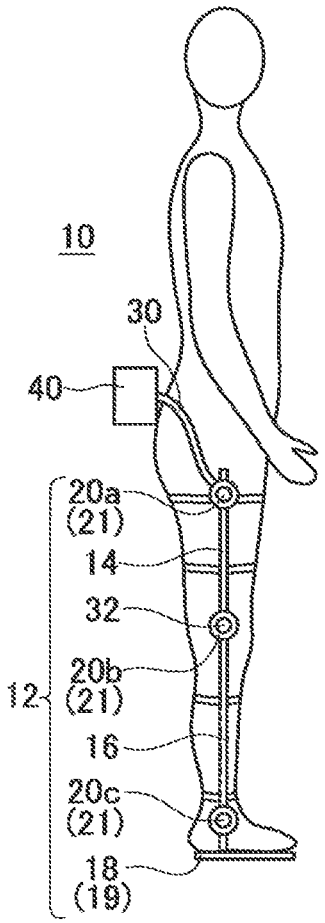
FIG. 3B is a schematic side view of a walking assist device according to an embodiment.

FIG. 3A shows a schematic front view of a walking assist device 10 according to the present embodiment, and FIG. 3B shows a schematic side view of the walking assist device 10.

The walking assist device 10 comprises a leg attachment 12 which is attached along a user's right leg (first leg) and a controller 40. The walking assist device of the present embodiment is a device for a user who is not able to move the knee joint of the right leg freely.

The mechanical structure of the leg attachment 12 will now be described. The leg attachment 12 is attached to the outer side of the user's first leg, from the upper leg to the lower leg. The leg attachment 12 is configured with a multi-link mechanism having an upper link 14, a lower link 16 and a foot link 18. The upper end of the upper link 14 is coupled swingably to a hip link 30 via a first joint 20*a*. The upper end of the lower link 16 is coupled swingably to the lower end of the upper link 14, by using the second joint 20*b*. The foot link 18 is coupled swingably to the lower end of the lower link 16 by a third joint 20*c*. The upper link 14 is fixed to the user's upper leg, by a belt. The lower link 16 is fixed to the user's lower leg, by a belt. The foot link 18 is fixed to the user's foot, by a belt. The belt which fixes the foot link 18 is not depicted in the drawings. The hip link 30 is fixed to the user's trunk (hips).

When the user is wearing the leg attachment 12, the first joint 20*a*, the second joint 20*b* and the third joint 20*c* are respectively disposed substantially coaxially with a pitch axis of the user's right hip joint, a pitch axis of the user's knee, and a pitch axis of the user's ankle. Each link of the leg attachment 12 can swing in accordance with the movement of the user's first leg. In each of the joints, the angle between the two adjacent links which are coupled to that joint, and which include an encoder 21 that detects the angle between the two links, corresponds to the angle of the user's joint. In other words, the encoders 21 detect the angles of the joints of the user. The encoder 21 of the first joint 20*a* detects the angle of the user's right hip joint around the pitch axis thereof. The encoder 21 of the second joint 20*b* detects the angle of the user's right knee joint around the pitch axis thereof. The encoder 21 of the third joint 20*b* detects the angle of the user's ankle joint around the pitch axis thereof. Below, the group of encoders 21 installed at the respective joints may be referred to generally as angle sensors 21.

A reaction force sensor 19 is attached to the foot link 18. The reaction force sensor 19 is installed in two locations at the front and rear of the sole of the foot. The main body of the reaction force sensor 19 is a load cell, which detects the load applied to the sole of the foot. This load corresponds to the floor reaction force received by the foot from the floor.

A motor (actuator) 32 is installed on the second joint 20*b*. The motor 32 is disposed to the outside of the user's knee joint. The motor 32 is disposed coaxially with the user's knee joint. The motor 32 is able to swing the lower link 16 relatively with respect to the upper link 14. In other words, the motor 32 is able to apply torque to the user's right knee joint.

This walking assist device assists a walking motion of the user by applying torque to the user's right knee joint (first leg knee joint) by using the motor 32.

A control process executed by the walking assist device 10 will now be described. The control process is executed by the controller 40. A target trajectory of the knee joint angle for performing a walking motion is stored in the controller 40 in advance. The target trajectory corresponds to time series data of the knee joint angle Ak in FIG. 1. Basically, the controller 40 controls the motor 32 in such a manner that the knee joint angle detected by the sensor follows the target trajectory. As described below, the controller 40 estimates the pre-swing timing from the sensor data, and corrects the target trajectory in such a manner that the motor 32 starts to apply the torque in the direction by which the torque causes the lower leg to swing backward at the estimated timing.

The controller 40 also stores a target trajectory for transferring from walking to a halt state, in addition to the target trajectory for the walking motion. The target trajectory for transferring from walking to the halt state will not be described herein.

Figure 4:
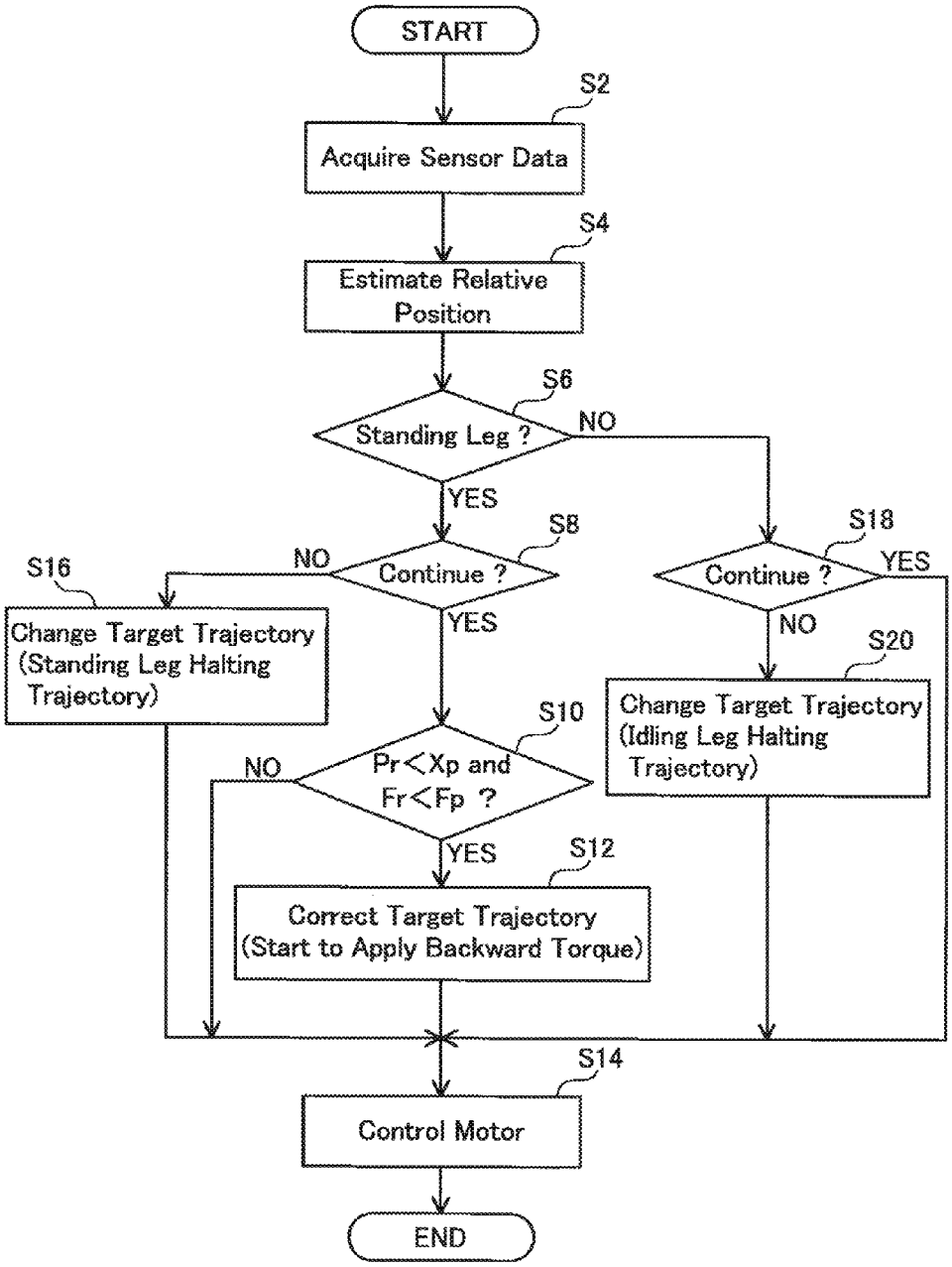
FIG. 4 is a flowchart diagram of processes which is executed by a walking assist device according to an embodiment.

FIG. 4 shows a flowchart of processes which is executed by the controller 40. The processes in FIG. 4 is repeated at each control cycle. The controller 40 acquires sensor data from the angle sensors 21 and the reaction force sensor 19 (S2). The controller 40 then estimates the relative position Pr of the right foot with respect to the hip, in the horizontal front/rear direction, from the sensor data of the angle sensors 21. The relative position Pr is determined by a so-called kinematic conversion which is known in the field of robotics, from the hip joint angle and the knee joint angle around the pitch axes.

Next, the controller 40 judges whether or not the first leg is a standing leg (S6). This judgment is based on deciding whether or not the detected floor reaction force Fr is greater than a predetermined threshold value (predetermined reaction force Fd). The predetermined reaction force Fd is set to a value equal to zero or slightly greater than zero. If the detected floor reaction force Fr is greater than the predetermined reaction force Fd, then the leg is judged to be the standing leg, and if this is not the case, then the leg is judged to be an idling leg.

If the first leg is judged not to be the standing leg (S6: NO), then the controller 40 subsequently judges whether or not the walking motion is continuing (S18). One specific example of this judgment is described below. The controller 40 continues to control the motor using the target trajectory, when it is judged that the walking motion is continued (S18: YES, S14). On the other hand, if it is judged that the walking motion is not continuing, in other words, if it is judged that the leg has transferred from the walking motion to the halt state, then the controller 40 changes the prevailing target trajectory to the halting trajectory for the idling leg, and controls the motor to follow this halting trajectory (S18: NO, S20, SI4).

If the first leg is judged to be the standing leg (S6: YES), then the controller 40 subsequently judges whether or not the walking motion is continuing (S8). One specific example of this judgment is described below. If it is judged that the walking motion is not continuing, in other words, if it is judged that the leg has transferred from the walking motion to the halt state, then the controller 40 changes the prevailing target trajectory to the halting trajectory for the standing leg, and controls the motor to follow this halting trajectory (S8: NO, S16, S14).

If it is judged at step S8 that a walking motion is continuing (S8: YES), then this corresponds to the following situation. In other words, the first leg is currently in a standing leg period and will transfer to an idling leg period at some stage. In this case, the controller 40 estimates the pre-swing timing (S10). More specifically, the controller 40 determines the timing at which the following two conditions are satisfied as the pre-swing timing. One condition is the condition that the estimated relative position Pr is backward from the hip by a predetermined distance Dr or more. In FIG. 4, this condition is expressed as "Pr<Xp". Xp is called the predetermined relative position. The predetermined relative position Xp is set to a position backward from the hip. In other words, the predetermined distance corresponds to the distance between the hip position and the predetermined relative position Xp.

A further condition is that the detected floor reaction force Fr is smaller than the predetermined reaction force Fp. In FIG. 4, this condition is expressed as "Fr<Fp". In the previous control period, it is probable that "Fr>Fp", and therefore the further condition corresponds to a condition for identifying the timing at which the detected floor reaction force has changed from a value equal to or greater than the predetermined reaction force Fp to a value not more than Fp. In other words, the further condition corresponds to a condition for identifying the timing at which the detected floor reaction force becomes lower than the predetermined reaction force. Here, as shown in FIG. 1, the predetermined reaction force Fp corresponds to the floor reaction force at timing Ta where the knee joint angle starts to change near the end of the standing leg period. The values of the predetermined relative position Xp and the predetermined reaction force Fp depend on the user's physique and posture when walking, and are therefore determined in advance through experimentation and analysis.

One example of detection of the pre-swing timing is described now on the basis of the example shown in FIG. I. "Pr<Xp" is satisfied slightly before the timing Ta. "Fr<Fp" is satisfied at the timing Ta, and that moment, in other words, the timing Ta is detected as the pre-swing timing.

By the process in step S10, the timing at which the lower leg starts to swing backward (the pre-swing timing) is estimated. The process in step S10 corresponds to a process in which the controller 40 specifies the timing for starting to apply torque to the knee joint in a direction causing the lower leg to swing backward, based on sensor data from the reaction force sensor 19 and the angle sensor 21. Following from the process in step S10, the controller 40 then corrects the target trajectory so as to output torque in a direction causing the lower leg to swing backward at the pre-swing timing (S12). The controller 40 then controls the motor in accordance with the corrected target trajectory (S14). The process in step S12 and the following step, S14, corresponds to process in which the controller 40 starts to apply torque, to the knee joint, in the direction which rotates the lower leg backward, at the timing that the floor reaction force detected while the foot of the first leg is positioned backward from the hip by the predetermined distance or more becomes lower than the predetermined reaction force Fp.

Figure 5:
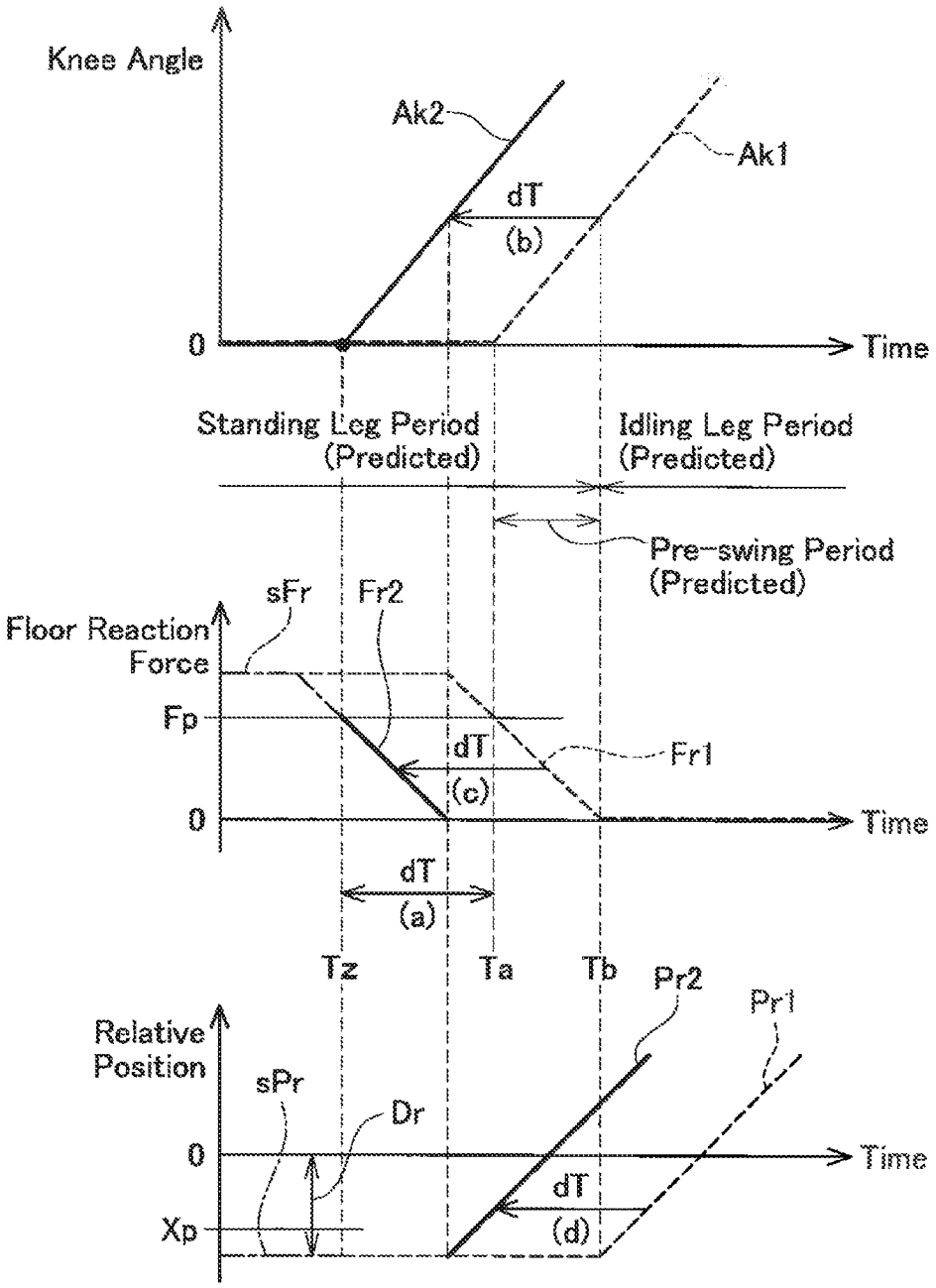
FIG. 5 is a diagram showing one example of correction of a target trajectory.

One example of correction of the target trajectory in step S12 is now described. FIG. 5 shows one example of a target trajectory correction process. The dotted line Ak1 in FIG. 5 indicates the target trajectory of the knee joint angle before correction. The dotted line Fr1 indicates the floor reaction force corresponding to the target trajectory Ak1 before correction. The dotted line Pr1 indicates the relative position corresponding to the target trajectory Ak1 before correction. As well as the target trajectory Ak1, the controller 40 also stores a predicted floor reaction force Fr1 and relative position Pr1, on the basis of the target trajectory Ak1. In other words, the controller 40 stores a predicted pre-swing timing Ta on the basis of the target trajectory Ak1.

The single-dotted line sFr in FIG. 5 indicates the detected floor reaction force and the single-dotted line sPr indicates the estimated relative position. At timing Tz, it is presumed that the judgment result of step S10 was "YES". At step S12, the controller 40 calculates the time difference dT between the pre-swing timing Tz estimated at step S10 and the predicted pre-swing timing Ta. (a) in FIG. 5 shows this calculation process. Thereupon, the controller 40 shifts the target trajectory Ak1 by the calculated time difference dT. (b) in FIG. 5 shows this shift process. Reference numeral Ak2 in FIG. 5 indicates the target trajectory after correction. In FIG. 5, the relative position sPr before the timing Tz traces a flat straight line. However, it should be noted that, in actual practice, the graph of sPr traces a curve in which the relative position sPr gradually moves backward away from the hip position as time passes, as shown in FIG. 1.

In step S14, the controller 40 controls the motor in accordance with the corrected target trajectory Ak2. After the correction of the target trajectory, the target trajectory Ak2 of the knee joint angle starts to increase from the timing Tz. In other words, the controller 40 starts to apply torque in a direction so as to cause the lower leg to swing backward at the estimated pre-swing timing Tz.

Due to the controller 40 controlling the motor in accordance with the target trajectory Ak2, the predicted floor reaction force Fr1 becomes Fr2 in actual practice (see reference symbol (c) in FIG. 5). Simultaneously, the predicted relative position Pr1 becomes Pr2 in actual practice (see reference symbol (d) in FIG. 5). In this way, the target trajectory is corrected so as to be compatible with the estimated pre-swing timing, and the timing at which the torque is applied in the direction so as to cause the lower leg to swing backward coincides substantially with the user's intentions. When the walking assist device of the present embodiment is functioning correctly, the user has no discomfort feeling when the torque is applied in the direction causing the lower leg to swing backward. In other words, the walking assist device 10 is able to assist the walking motion while remarkably reducing the discomfort feeling caused to the user in the pre-swing period.

Figures 6, 7, 8:
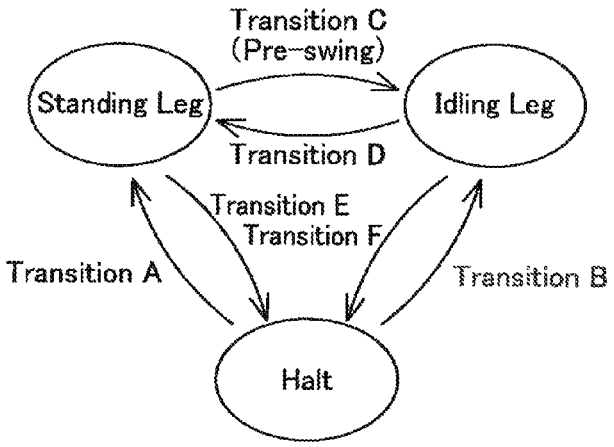
FIG. 6 is a state transition diagram of a walking motion.
FIG. 7 is a diagram showing conditions of state transition judgments in a walking assist device according to an embodiment.
FIG. 8 is a diagram showing conditions of state transition judgments in a walking assist device according to a second embodiment.

Next, a process by which the controller 40 judges the period (phase) to which the state of the first leg (right leg) currently belongs will be described. FIG. 6 shows types of phase to which the first leg can belong. FIG. 7 shows references employed by the controller 40 to judge transitions between the phases. The first leg can belong to three phases: "standing leg", "idling leg", "halt". It should be noted that the judgment process described below can also be applied to the second leg (left leg).

The controller 40 judges that the first leg has transferred to the standing leg phase when the relative position Pr of the first leg in the halt phase is backward from the predetermined relative position Xa (transition A). The predetermined relative position Xa is set to a position backward than the hip position and forward than the predetermined relative position Xp used in order to estimate the pre-swing timing.

The controller 40 judges that the first leg has transferred to the idling leg phase (transition B) when the relative position Pr of the first leg in the halt phase is forward from the predetermined relative position Xb, and the floor reaction force Fr is smaller than the predetermined reaction force Fb, and furthermore, the velocity Vr of the foot of the first leg is larger than the predetermined velocity Vb. The predetermined relative position Xb is set forward than the hip position.

The controller 40 judges that the first leg has transferred to an idling leg phase (transition C), when the relative position Pr of the first leg in the standing leg phase is backward from the predetermined relative position Xp, and the floor reaction force Fr of the first leg has become smaller than the predetermined reaction force Fp. This process corresponds to the judgment in step SI 0 described above. It should be noted that transition C involves the first leg in the standing leg phase transferring to the idling leg phase by passing through a pre-swing phase (pre-swing period). The pre-swing phase corresponds to final period of the standing leg phase.

The controller 40 judges that the first leg has transferred to the standing leg phase (transition D) when the relative position Pr of the first leg belonging to the idling leg phase is forward from the predetermined relative position Xd, the floor reaction force Fr is greater than the predetermined reaction force Fd, and the velocity of the foot Vr has become lower than a predetermined velocity Vd. The predetermined relative position Xd is set forward than the hip position.

The controller 40 judges that the first leg has transferred to the halt phase (transition E) when the first leg has continued in the standing leg phase for a predetermined time period Td1 or longer. Furthermore, the controller 40 judges that the first leg has transferred to the halt phase (transition F) when the first leg has continued in the idling leg phase for a predetermined time period Td2 or longer. The judgment about transition E corresponds to the "NO" judgment in step S8. The judgment about transition F corresponds to the "NO" judgment in step SI 8.

Next, a walking assist device according to a second embodiment will be described. The walking assist device according to the second embodiment employs a grounding sensor instead of the reaction force sensor 19 in the walking assist device 10 according to the first embodiment. The grounding sensor outputs ON (grounded) when the foot is detected as touching the ground and outputs OFF (not grounded) when the foot is not detected as touching the ground. Therefore, the walking assist device according to the second embodiment detects the timing at which the output of the grounding sensor switches from OFF to ON, as the grounding timing. Furthermore, the walking assist device detects the timing at which the output of the grounding sensor switches from ON to OFF, as the ground leave timing. Below, the "reaction force sensor 19" is substituted with the "grounding sensor 19". The walking assist device according to the second embodiment differs from the first embodiment in respect of the process in step S10. The walking assist device according to the second embodiment carries out the following process instead of the process in step S10 of the first embodiment.

The walking assist device corrects the target trajectory when the relative position Pr of the first leg is backward than the predetermined relative position Xp and the wound leave timing has been detected. The walking assist device corrects the target trajectory so as to start to apply torque causing the lower leg to swing backward. A concrete example of the correction of the target trajectory is substantially the same as the case of the first embodiment. The walking assist device according to the second embodiment includes the following technical features. The walking assist device comprises an actuator (motor 32) that applies torque to a knee joint of a first leg, a grounding sensor (19) that detects a timing when a foot of the first leg leaves a ground, and a rotation angle sensor (21) that detects a hip joint angle of the first leg around a pitch axis. The walking assist device carries out the following processes. The walking assist device estimates a relative position Pr of the foot of the first leg with respect to the hip in a horizontal direction, based on the detected hip joint angle. The walking assist device then starts to apply torque to the knee joint in a direction in which the torque swings the lower leg backward, at a timing when the foot of the first leg leaves the ground, when the foot of the first leg is positioned backward from the hip at or more than a predetermined distance Dr.

The walking assist device according to the second embodiment starts to apply the torque to swing the lower leg backward at a ground leave timing. The walking assist device according to the second embodiment is slightly inferior to the walking assist device according to the first embodiment, but is able to assist a walking motion while reducing a discomfort feeling caused to the user.

The processes carried out by the controller of the walking assist device of the second embodiment to judge the period (phase, see FIG. 6) to which the state of the first leg belongs will now be described. FIG. 8 shows references employed by the controller of the walking assist device of the second embodiment to judge transitions between phases. The first leg can belong to three phases: "standing leg", "idling leg", "halt". It should be noted that the judgment process described below can also be applied to the second leg (left leg). The judgments about transition A, transition E and transition F are similar to those of the first embodiment and description thereof is omitted here.

The controller judges that the first leg has transferred to the idling leg phase (transition B), when the relative position Pr of the first leg in the halt phase is forward than the predetermined relative position Xb, and a ground touch timing of the first leg has been detected (the output of the grounding sensor has switched from OFF to ON), and the velocity Vr of the foot of the first leg has become greater than a predetermined velocity Vb.

The controller judges that the first leg has transferred to an idling leg phase (transition C), when the relative position Pr of the first leg in the standing leg phase is backward from the predetermined relative position Xp, and the ground leave timing of the first leg has been detected (the output of the grounding sensor has switched from ON to OFF). This process corresponds to the judgment in step S10 of the second embodiment. It should be noted that the transition C in the second embodiment is a transition from the standing leg phase including the pre-swing phase to the idling leg phase.

The controller judges that the first leg has transferred to the standing leg phase (transition D) when the relative position Pr of the first leg in the idling leg phase is forward than the predetermined relative position Xd, and the ground touch timing has been detected (the output of the grounding sensor has switched from OFF to ON), and the velocity of the foot Vr has become lower than a predetermined velocity Vd. The predetermined relative position Xd is set forward than the hip position.

Preferred embodiments of the present invention have been described above. The notable points relating to the technique disclosed by the present specification will now be described. The walking assist device 10 according to the first embodiment estimates a pre-swing timing based on the detection from a reaction force sensor 19 and an angle sensor 21, and corrects a target trajectory so as to reduce a discomfort feeling caused to the user when torque is applied. The characteristics of a walking assist device of this kind can be expressed as follows. The controller of the walking assist device stores a target trajectory of the knee joint angle of a first leg (one leg). The controller controls the actuator in such a manner that the detected knee joint angle follows a target trajectory. The target trajectory indicates the time change of the knee joint angle when transferring from a standing leg to an idling leg. The controller also stores time change data about the predicted floor reaction force corresponding to the target trajectory. The controller estimates a relative position Pr of the foot of the first leg with respect to the hip in a horizontal direction, based on the detected hip joint angle. The controller identifies a timing at which the estimated relative position Pr is backward from the hip by a predetermined distance or more (Pr<Xp), and the detected floor reaction force Fr is lower than the predetermined reaction force Fp, in a standing leg period of the first leg (and desirably, in the latter half of the standing leg period). The controller shifts the target trajectory by a time difference dT with respect to the timing at which the predicted floor reaction force became lower than the predetermined reaction force Fp.

Furthermore, it is also suitable to use an angle of inclination sensor capable of detecting an absolute hip joint angle with respect to the vertical direction, instead of the encoder 21 which detects the hip joint angle. By using an angle of inclination sensor of this kind, it is possible accurately to estimate the relative position of the foot.

Concrete examples of the present invention were described in detail above, but these are no more than illustrative examples, which do not restrict the scope of the claims. The techniques described in the claims includes various changes and modifications to the concrete examples given above. The technical elements described in the specification or illustrated in the drawings display technical utility either independently or in combination, and are not limited to the combinations stated in the claims at the time of application. Furthermore, the techniques described in the specification or illustrated in the drawings can achieve a plurality of objects simultaneously, and have technical utility in achieving any one of this plurality of objects.

The invention claimed is:

1. A walking assist device for assisting walking motion of a user, the walking assist device comprising:

a controller;

an actuator configured to apply torque to a knee joint of one leg;

a reaction force sensor that detects reaction force which a foot of the one leg receives from a floor; and an angle sensor that detects a hip joint angle of the one leg around a pitch axis, wherein the controller is configured to:

estimate a first position where the first position is a relative position of the foot of the one leg with respect to a hip of the one leg in the horizontal direction based on the detected hip joint angle; and when the detected reaction force decreases below a predetermined reaction force value and the estimated first position is backward from the hip of the one leg in the horizontal direction by a predetermined distance or more, the controller is further configured to control the actuator to start applying the torque to the knee joint such that a lower leg of the one leg swings backward.

2. The walking assist device of claim 1, wherein the predetermined reaction force value is greater than zero.

3. A walking assist device for assisting walking motion of a user, the walking assist device comprising:

a controller;

an actuator configured to apply torque to a knee joint of one leg;

a grounding sensor that detects a timing when a foot of the one leg leaves a ground; and a rotation angle sensor that detects a hip joint angle of the one leg around a pitch axis, wherein the controller is configured to:

estimate a first position where the first position is a relative position of the foot of the one leg with respect to a hip of the one leg in the horizontal direction based on the detected hip joint angle; and when the foot of the one leg leaves the ground and the estimated first position is backward from the hip of the one leg in the horizontal direction by a predetermined distance or more, the controller is further configured to control the actuator to start applying the torque to the knee joint such that a lower leg of the one leg swings backward.

* * * * *